US006726550B2

(12) United States Patent
Nishihara

(10) Patent No.: US 6,726,550 B2
(45) Date of Patent: Apr. 27, 2004

(54) POLISHING APPARATUS

(75) Inventor: Jun Nishihara, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/171,070

(22) Filed: Jun. 13, 2002

(65) Prior Publication Data

US 2003/0013391 A1 Jan. 16, 2003

(30) Foreign Application Priority Data

Jun. 13, 2001 (JP) ..... P2001-178855

(51) Int. Cl.[7] ..... B24B 5/00
(52) U.S. Cl. ..... 451/285; 451/548; 451/288
(58) Field of Search ..... 451/285–288, 451/548, 41, 916, 28

(56) References Cited

U.S. PATENT DOCUMENTS 2,589,661 A * 3/1952 Belcher, Jr. ..... 451/541
5,394,655 A * 3/1995 Allen et al. ..... 451/63
5,967,885 A * 10/1999 Crevasse et al. ..... 451/285
6,447,381 B1 * 9/2002 Kubo ..... 451/288

* cited by examiner

*Primary Examiner*—Lee D. Wilson
(74) *Attorney, Agent, or Firm*—Sonnenschein, Nath & Rosenthal LLP

(57) ABSTRACT

There is disclosed is a chemical mechanical polishing apparatus having a inexpensive simplified configuration, which minimizes consumption of slurry material and securely enabling washing of a polishing pad. By virtue of the provision of the inventive slurry stoppers, the chemical mechanical polishing apparatus prevents slurry from vainly falling off from the polishing pad in the course of polishing a wafer, and yet, while washing the polishing pad, in order that slurry not to remain on the polishing pad, and yet, in order that an end of adjoining slurry stoppers can be disposed across predetermined intervals in the inner and outer directions of the polishing pad, a plurality of slurry stoppers are retained to the polishing pad across substantially equal angular intervals along external periphery of the polishing pad by applying adhesive agent for example.

10 Claims, 4 Drawing Sheets

POLISHING APPARATUS

CROSS REFERENCE TO RELATED APPLICATIONS

This application claims priority to Japanese Patent Application No. JP 2001-178855, filed on Jun. 13, 2001, the disclosure of such application being herein incorporated by reference to the extent permitted by law.

BACKGROUND OF THE INVENTION

1. Field of the Invention:

The present invention relates to a chemical mechanical polishing apparatus (hereinafter referred to as CMP apparatus). More particularly, the present invention relates to a CMP apparatus featuring a configuration of a polishing pad thereof.

2. Description of the Related Art:

As a result of increasing integration of LSI chips, internal wiring configuration has become still finer along with further multiplication of wiring layers. Because of this, in the production of a semiconductor apparatus, a technology for fully leveling off or smoothing a wafer surface has become an important issue to be taken into consideration. As a countermeasure for solving such leveling issue, such an art for leveling off the wafer surface by applying chemical mechanical polishing method has been practiced. As schematically shown in FIG. 4, for example, a conventional CMP apparatus utilizes a rotary platen 1 having attached thereto a porous polishing pad 6 made from foamed urethane resin, for example. This system feeds slurry 7 composed of aqueous solution containing polishing agent such as silica to the polishing pad 6 via a nozzle. For example, a wafer is secured to a vertically movable head 7 via a cylinder. While pressing the wafer against the polishing pad 6, the wafer is polished with slurry 7 by way of rotating the platen 1 and the head 7.

FIGS. 5A and 5B schematically shows a conventional polishing pad 6 utilized by a conventional CMP apparatus. FIG. 5A designates a plan view, whereas FIG. 5B designates a lateral view thereof. As shown in FIG. 6A, the polishing pad 6 has disc-shaped configuration. As shown here, the polishing pad 6 is rotated in a clockwise direction when viewed from top in the figure, for example, at a revolving speed of approximately 50 to 150 rpm. The Slurry 7 is fed to the substantially central portion of the polishing pad 6 at a feeding rate of 100 to 300 cc/min., for example. After being fed, slurry 7 spreads itself over the pad surface via centrifugal effect generated by the rotating the platen 2. While this condition is kept, the head 1 is pressed against the polishing pad 6 with constant pressure so that the head 1 can be rotated to polish a wafer secured to the head 1 whereby leveling off the wafer surface.

During or after the polishing process, while applying pressure to the polishing pad 6, a dresser 3 shown in FIG. 5 is rotated itself to come into contact with the polishing pad 6 in order to provide the surface of the polishing pad 6 with sawing function.

On the other hand, while operating the above conventional CMP apparatus to execute a polishing process, a problem as cited below may occur. That is, the slurry 7 fed to the polishing pad 6 helically diffuses towards a peripheral edge of the surface of the disc-form polishing pad 6 from the center portion and then leaks or falls outwardly from the peripheral edge thereof to result in waste of the slurry material.

In view of such problem, there is a proposal for preventing the slurry 7 from outwardly falling from the peripheral edge of the polishing pad 6 by way of banking the peripheral edge thereof. FIG. 6A designates a plan view of a conventional polishing pad with such feature, whereas FIG. 6B designates a lateral view thereof.

As described above, the above method for polishing a wafer surface by way of feeding slurry 7 into the polishing pad 6 is effective to minimize waste of slurry material 7. On the other hand, inasmuch as slurry 7 is constantly held inside of the polishing pad 6, when setting the sawing function of the polishing pad 6 with the dresser 3 after completing the polishing of the wafer, the polishing pad 6 cannot properly be adjusted for setting the sawing function under the existing state. Further, inasmuch as part of ingredients contained in the slurry 7 coheres itself without allowing to wash it off, it is very likely to cause the wafer surface to incur undesirable scratch, thus raising a critical problem.

Japanese Laid-Open Patent Publication No. HEISEI-11-58218 (1999) discloses another art which proposes such a polishing pad and a polishing apparatus comprising such a system in which a polishing pad is provided with a through-hole for feeding polishing solution (slurry) and another through-hole for discharging slurry to enable the system to discharge slurry simultaneously with a process of feeding slurry thereto.

According to this art, although it is certain that the above-cited problems can be solved, it is required to provide the polishing pad with a specially configured construction whereby resulting in a considerably complicated construction, thus incurring increased cost as a problem to be solved.

SUMMARY OF THE INVENTION

The present invention has been conceived in view of the above mentioned problems by providing a novel CMP apparatus which is configured with a simplified construction that may be capable of minimizing cost and consumption of slurry, and yet, capable of securely washing slurry off from the polishing pad.

According to a first preferred embodiment of the present invention, there is provided a polishing apparatus for polishing an object by causing a polishing pad and the object having rotation relative to each other to be abutted to each other via slurry; the chemical mechanical polishing apparatus includes a plurality of slurry stoppers individually positioned across substantially equal angular intervals along an external periphery of the polishing pad and the plurality of slurry stoppers are positioned by determining a predetermined interval on the polishing pad.

According to second preferred embodiment of the present invention, there is provided a polishing apparatus for polishing an object by causing a polishing pad and the object having rotation relative to each other to be abutted to each other via slurry; the chemical mechanical polishing apparatus includes a plurality of slurry stoppers individually positioned across substantially equal angular intervals along an external periphery of the polishing pad and each of the plurality of slurry stoppers are individually disposed obliquely against a direction of rotation of the polishing pad.

According to still another preferred embodiment of the present invention, there is provided a polishing apparatus according the second preferred embodiment, in which the plurality of slurry stoppers are individually disposed by being slanted by an angle relative to a direction of rotation of the polishing pad determined according to a rotation speed to which the polishing pad is submitted.

According to still another preferred embodiment of the present invention, there is provided a polishing apparatus according the second preferred embodiment, in which the plurality of slurry stoppers are individually disposed by being slanted by approximately 5劫 to 45劫 in relation to a direction of rotation of the polishing pad.

According to still another preferred embodiment of the present invention, there is provided a polishing apparatus according to any of the above mentioned preferred embodiments, in which the plurality of slurry stoppers are attached to the polishing pad.

According to the preferred embodiments of the present invention, it is possible for the inventive (chemical mechanical) polishing apparatus to minimize consumption of slurry by applying a simplified construction, and yet, allow a dresser to set saw and wash off slurry without considerable obstruction. Further, inasmuch as slurry is prevented from cohering itself, unwanted scratch on the wafer may be prevented.

The novel (chemical mechanical) polishing apparatus according to the preferred embodiments of the present invention may also be realized merely by attaching a plurality of slurry stoppers to the polishing pad, and thus, it is possible to manufacture the inventive polishing apparatus at comparatively reduced cost by way of utilizing a conventional polishing pad.

BRIEF DESCRIPTION OF THE DRAWINGS

The above and other objects, features and advantages of the present invention will become more apparent to those skilled in the art from the following description of the presently preferred exemplary embodiments of the invention taken in conjunction with the accompanying drawings, in which.

DESCRIPTION OF THE PREFERRED EMBODIMENTS

Referring now to the accompanying drawings, preferred embodiments of the present invention are described below.

Figure 1A:
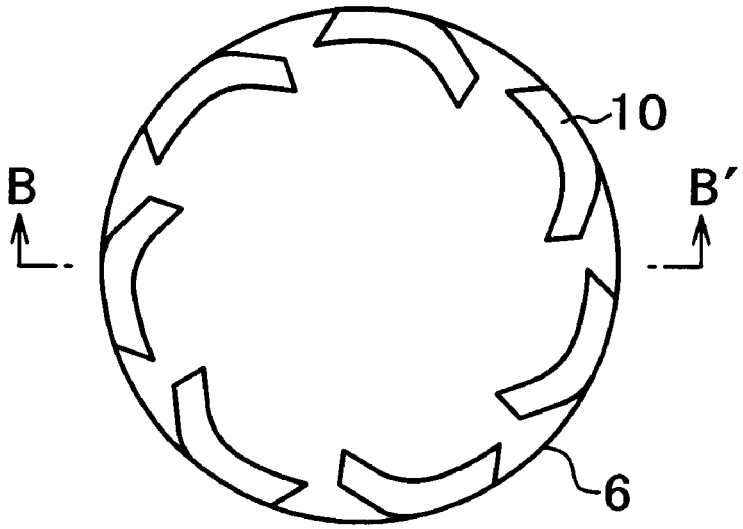
FIG. 1A schematically shows a plan view of an embodiment of the polishing pad provided with a plurality of slurry stoppers according to a preferred embodiment of the present invention.
Figure 1B:
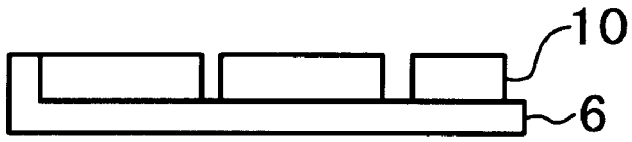
FIG. 1B schematically shows a lateral view of the polishing pad shown in FIG. 1A.

FIG. 1A schematically shows a plan view of an inventive polishing pad 6, whereas FIG. 1B schematically shows a lateral view thereof. The inventive polishing pad 6 is includes a construction having a plurality of slurry stoppers 10 provided along an inner periphery of a conventional polishing pad. As shown in FIG. 1A, the slurry stoppers 10 are individually configured as plate members, blades or the like with a predetermined length and an inwardly curved or bended center portion.

In order that openings for allowing flow of slurry can be formed between adjacent slurry stoppers 10, all the slurry stoppers 10 are individually disposed across substantially equal angular intervals along the external periphery of the polishing pad 6.

Figure 2A:
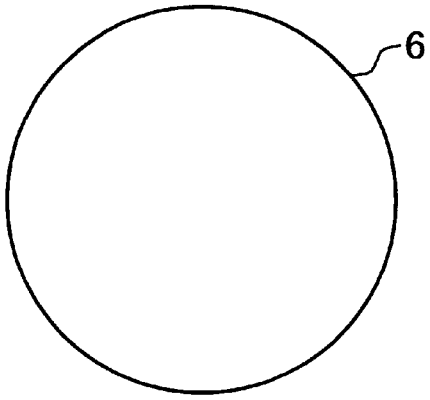
FIGS. 2A and 2B schematically shows a procedure for fabricating a polishing pad provided with a plurality of slurry stoppers according to a preferred embodiment of the present invention.
Figure 2B:
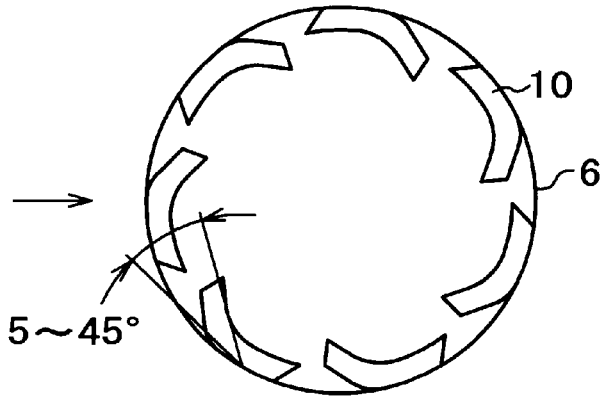

FIGS. 2A and 2B describe a procedure for fabricating a inventive polishing pad 6 internally fitted with the slurry stoppers 10, according to the preferred embodiment of the present invention. Specifically, the slurry stoppers 10 are individually disposed along an external periphery of a conventional polishing pad 6 by way of inclining longitudinal axial line by 5劫 to 45劫 against a direction of the rotation of a platen 2, i.e., the polishing pad 6. For example, the slurry stoppers 10 are secured to the external periphery of the polishing pad 6 by applying any optional means such as adhesive, retaining agent or the like. Because of this arrangement, openings across predetermined intervals are generated between end portions of adjacent slurry stoppers 10 in the inner and outer directions of a friction pad or a platen.

As described above, each of the slurry stoppers 10 is obliquely secured against a direction of rotation of the polishing pad 6. This is because of the fact that the slurry stoppers 10 should properly be disposed by considering flowing direction of slurry in order that slurry helically flowing over the surface of the polishing pad 6 can effectively be prevented from flowing off. Further, inasmuch as the flowing direction of slurry is variable in correspondence with a speed of rotation of the platen, the angular range specified above as an example is determined by way of considering the speed of the rotation of the platen (rated, in the present example, to be in a range from approximately 50 rpm to 150 rpm).

In the above structural arrangement, when slurry 7 is fed via rotation of the platen 2, because of centrifugal force generated by the rotating platen 2, slurry 7 helically flows itself from the center portion of the polishing pad 6 towards peripheral edge of the polishing pad 6. However, inasmuch as slurry 7 is prevented from flowing itself by the slurry stoppers 10 set along the peripheral edge of the polishing pad 6, slurry 7 is prevented from outwardly falling off from the peripheral edge.

On the other hand, inasmuch as there are a plurality of openings between a number of slurry stoppers 10 adjoining or adjacent themselves along peripheral edge of the polishing pad 6, in the case of setting saw on the surface of the polishing pad 6 and washing slurry off, slurry 7 flows out of the polishing pad 6 via openings without remaining thereon, and thus, substantially no obstruction occurs in the saw-setting and washing operation, and yet, wafer is freed from incurring in undesired scratch.

As described above, the term "predetermined intervals" mean such plural intervals for preventing the slurry stoppers 10 from externally flowing themselves out from the external peripheral edge of the polishing pad 6, and yet, said intervals also mean such intervals for allowing slurry 7 to flow itself out from the polishing pad 6 through the intervals in the case of setting saw on the surface of the polishing pad 6 and washing slurry off from the polishing pad.

Figure 3:
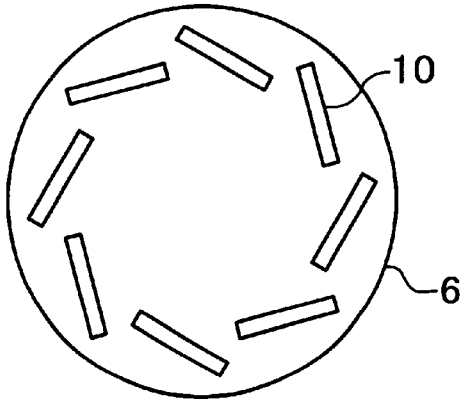
FIG. 3 schematically shows a plan view of a polishing pad according to another preferred embodiment of the present invention.
Figure 4:
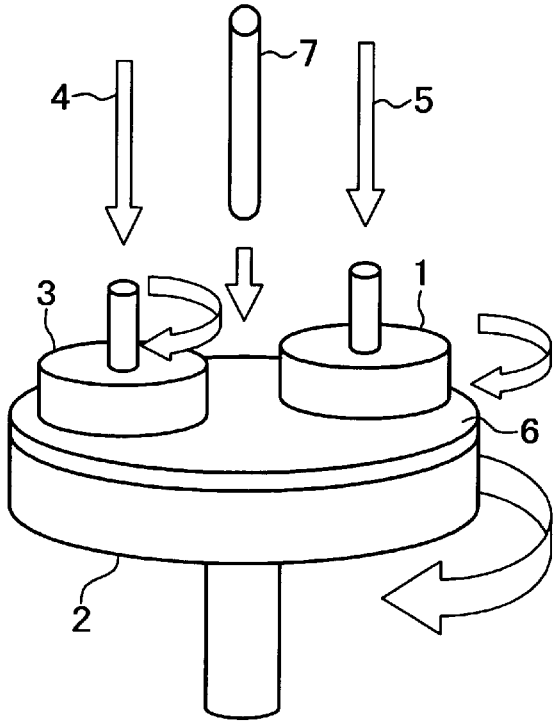
FIG. 4 schematically shows a perspective view of the CMP apparatus according to the present invention.
Figure 5A:
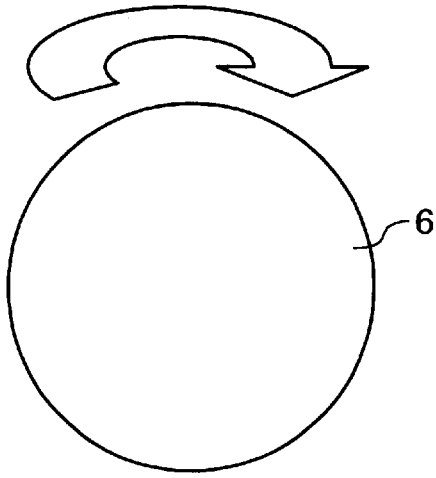
FIG. 5A schematically shows a plan view of a conventional polishing pad, whereas FIG. 5B designates a lateral view thereof, and FIG. 6A schematically shows a plan view of another example of a conventional polishing pad, whereas FIG. 6B designates a lateral view thereof.
Figure 5B:
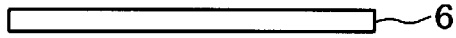
Figure 6A:
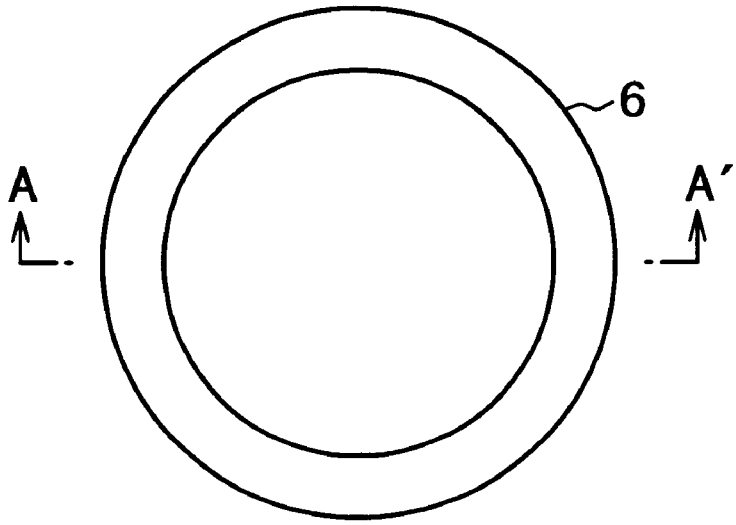
Figure 6B:
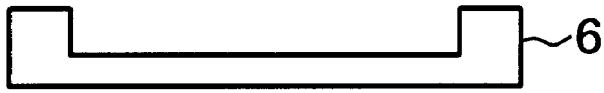

FIG. 3 exemplifies one of possible variations of the inventive slurry stoppers 10, according to another preferred embodiment of the present invention. In this embodiment, except for the rectangular configuration, substantially all the functional features of the varied-form slurry stoppers 10 are similar to those of the slurry stoppers 10 exemplified in the preceding preferred embodiment described above. As a matter of course, the varied-form slurry stoppers 10 may preferably generate the above-described functional advantages as well.

It should be understood that, not only those preferred embodiments of the present invention exemplified above are applicable, but many other variations, combinations and sub combinations may be preformed without departing from the scope of the present invention. For example, each of the inventive slurry stopper 10 may also be formed with any discretional configuration such as arc-shaped plate for example.

What is claimed is:

1. A chemical mechanical polishing apparatus for polishing an object by causing a polishing pad and said object having rotation relative to each other to be abutted to each other via slurry, said chemical mechanical polishing apparatus comprising:

a plurality of slurry stoppers individually positioned across substantially equal angular intervals along an external periphery of said polishing pad; wherein said plurality of slurry stoppers are positioned by determining an interval on said polishing pad, and each slurry stopper has an inwardly curved portion, which is not along an outer circumference of said polishing pad.

2. A polishing apparatus for polishing an object by causing a polishing pad and said object having rotation relative to each other to be abutted to each other via slurry, said chemical mechanical polishing apparatus comprising:

a plurality of slurry stoppers individually positioned across substantially equal angular intervals along an external periphery of said polishing pad; wherein each said plurality of slurry stoppers are individually disposed obliquely against a direction of rotation of said polishing pad, and each slurry stopper has an inwardly curved portion, which is not along an outer circumference of said polishing pad.

3. The polishing apparatus according to claim 2, wherein said plurality of slurry stoppers are individually disposed so as to slant by an angle relative to a direction of rotation of said polishing pad, wherein said angle is determined according to a rotation speed of said polishing pad.

4. The polishing apparatus according to claim 2, wherein said plurality of slurry stoppers are individually disposed so as to slant between approximately 5° to 45° in relation to a direction of rotation of said polishing pad.

5. The polishing apparatus according to any of the preceding claims, wherein said plurality of slurry stoppers are attached to said polishing pad.

6. A chemical mechanical polishing apparatus for polishing an object comprising:

a circular polishing pad having a center;

a plurality of slurry stoppers projecting from said polishing pad, wherein each slurry stopper is positioned along an external periphery of said polishing pad, each slurry stopper has a first end opposed to a second end, and the distance from the first end to the center is greater than the distance from the second end to the center.

7. The polishing apparatus according to claim 6, wherein said plurality of slurry stoppers are positioned by determining an interval on said polishing pad.

8. The polishing apparatus according to claim 6, wherein each slurry stopper has an inwardly curved portion.

9. The polishing apparatus according to claim 6, wherein each slurry stopper is individually positioned across a substantially equal angular interval along an external periphery of said polishing pad.

10. The polishing apparatus according to claim 6, wherein each slurry stopper has a first portion at a first distance from the center of the polishing pad and a second portion that is closer to the center than the first portion.

* * * * *